US008177029B1

(12) United States Patent
Norton et al.

(10) Patent No.: US 8,177,029 B1
(45) Date of Patent: May 15, 2012

(54) TOOL AND SUPPLY BAG FOR USE WITH A STEPLADDER

(76) Inventors: Clint Norton, North Vernon, IN (US); Daniel Rosenbalm, North Vernon, IN (US)

( * ) Notice: Subject to any disclaimer, the term of this patent is extended or adjusted under 35 U.S.C. 154(b) by 130 days.

(21) Appl. No.: 12/712,351

(22) Filed: Feb. 25, 2010

(51) Int. Cl.
*B65D 85/28* (2006.01)

(52) U.S. Cl. ..... 182/129; 206/373

(58) Field of Classification Search ..... 182/129; 206/373

See application file for complete search history.

(56) References Cited

U.S. PATENT DOCUMENTS 4,356,854 A 11/1982 McGee
5,437,502 A * 8/1995 Warnick et al. ..... 312/244
5,511,753 A 4/1996 Lage
5,638,915 A 6/1997 Hardy
5,813,530 A * 9/1998 Kornblatt ..... 206/373
D410,551 S 6/1999 Guimont et al.
6,766,881 B2 7/2004 Carty
6,892,914 B2 * 5/2005 Girbert ..... 224/625
7,055,652 B1 6/2006 Williams
7,195,119 B2 * 3/2007 Lungo ..... 206/373
2002/0070137 A1 * 6/2002 Hedges ..... 206/373

* cited by examiner

*Primary Examiner* — Alvin Chin Shue
(74) *Attorney, Agent, or Firm* — Kyle Fletcher

(57) ABSTRACT

The tool and supply bag includes a frame that can rest atop a stepladder, and further includes a tool and supply bag that attaches about the exterior of said frame. A removable box or cooler accompanies the tool and supply bag and provides further storage when carrying the device to and from a stepladder via a shoulder strap. The tool and supply bag still provides access to the paint holder accessory of a ladder. At least one optional holster is included on the tool and supply bag as a means of supporting a tape measure, cordless drill, or like-handled tool.

21 Claims, 6 Drawing Sheets

FIG. 3A
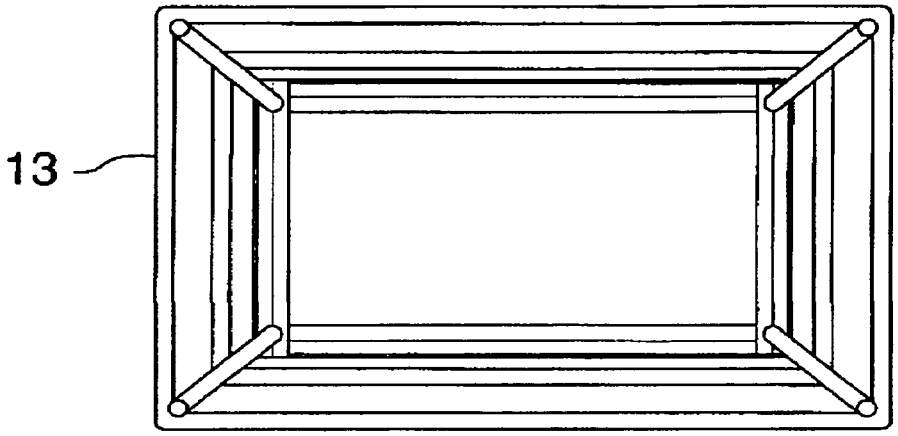
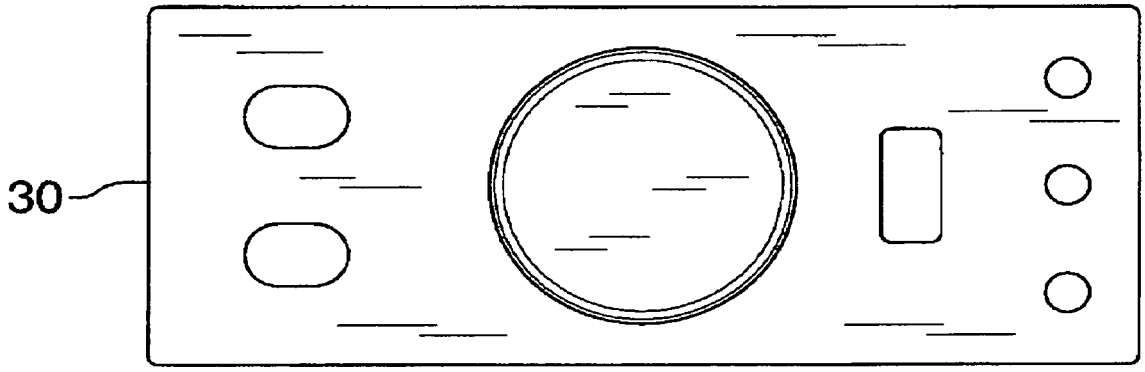
FIG. 3B

TOOL AND SUPPLY BAG FOR USE WITH A STEPLADDER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of ladder accessories, more specifically, a tool and supply bag that can be affixed atop a stepladder.

B. Discussion of the Prior Art

As a preliminary note, it should be stated that there is an ample amount of prior art that deals with ladder accessories. As will be discussed immediately below, no prior art discloses a ladder accessory that has a frame that supports a box and bag and wherein said frame rests along the top of said stepladder.

The Williams patent (U.S. Pat. No. 7,055,652) discloses a holder for holding tools at the top of a ladder. However, the holder requires clips for securement of the holder to the ladder via a strap as opposed to a frame that slides upon the top of said ladder, and of which further includes a removable box or cooler for further storage.

The McGee patent (U.S. Pat. No. 4,356,854) discloses a tool pouch for mounting to the top of a ladder. However, the tool pouch is not supported via a frame that is draped across the top of the ladder, and of which a removable box is provided for further storage.

The Carty patent (U.S. Pat. No. 6,766,881) discloses another tool holding device that attaches to the top rung of a ladder. However, the tool holder requires straps to secure the tool holder to the top of the ladder, as opposed to a frame that fits atop said ladder and further includes a removable box that can be used for further storage.

The Lage patent (U.S. Pat. No. 5,511,753) discloses a paint can holder for supporting a can of paint at the top rung of a ladder. However, the paint can holder is not suited for providing a plurality of storage compartments for tools and materials. Also, the paint can holder does not mount atop a stepladder via a frame that drapes over the top of said ladder.

The Hardy patent (U.S. Pat. No. 5,638,915) discloses a tool storage device that mounts to the top of a ladder. However, the device mounts atop a ladder via a plurality of straps as opposed to a frame that fits atop said ladder.

While the above-described devices fulfill their respective and particular objects and requirements, they do not describe a tool and supply bag that rests atop a stepladder via a frame, and of which includes a removable box that can store more items when carrying the supply bag to and from a stepladder. In this regard, the tool and supply bag departs from the conventional concepts and designs of the prior art.

SUMMARY OF THE INVENTION

The tool and supply bag includes a frame that can rest atop a stepladder, and further includes a tool and supply bag that attaches about the exterior of said frame. A removable box or cooler accompanies the tool and supply bag and provides further storage when carrying the device to and from a stepladder via a shoulder strap. The tool and supply bag still provides access to the paint holder accessory of a ladder. At least one optional holster is included on the tool and supply bag as a means of supporting a tape measure, cordless drill, or like-handled tool.

An object of the invention is to provide a tool and supply bag with a plurality of pockets along an exterior from which said tool and supply bag is draped upon a frame.

A further object of the invention is to provide a frame that fits over the top of a stepladder.

A further object of the invention is to provide a shoulder strap for carrying the tool and supply bag.

A further object of the invention is to provide a removable box that fits within a top opening of the tool and supply bag, and of which said removable box provides more storage when carrying the invention to and from a stepladder.

A further object of the invention is to provide a tool and supply bag for use with a stepladder that is simple in design, effective, easy-to use, easy to install and remove from a stepladder, easy to manufacture, and is affordable.

These together with additional objects, features and advantages of the tool and supply bag for use with a stepladder will be readily apparent to those of ordinary skill in the art upon reading the following detailed description of presently preferred, but nonetheless illustrative, embodiments of the tool and supply bag for use with a stepladder when taken in conjunction with the accompanying drawings.

In this respect, before explaining the current embodiments of the tool and supply bag for use with a stepladder in detail, it is to be understood that the tool and supply bag for use with a stepladder is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the tool and supply bag for use with a stepladder.

It is therefore important that the claims be regarded as including such equivalent construction insofar as they do not depart from the spirit and scope of the tool and supply bag for use with a stepladder. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Detailed reference will now be made to the preferred embodiment of the invention, examples of which are illustrated in FIGS. 1-5. An invention 10 includes a removable box 11, a tool and supply bag 12, and a frame 13.

The tool and supply bag 12 has a tool holster 12A that further includes a strap 12A' for securing a cordless drill (not depicted), or like handled tool. The tool and supply bag 12 also includes a hammer loop 12D for holding a hammer or like handled tool, and a center pocket 12E that is used to store a tape measure. The tool and supply bag 12 includes a removable shoulder strap 12B, and features a top opening 12C. The inclusion of the shoulder strap 12B enables the tool and supply bag 12 to be carried about by itself or in conjunction with the removable box 11 and/or the frame 13.

Figure 1:
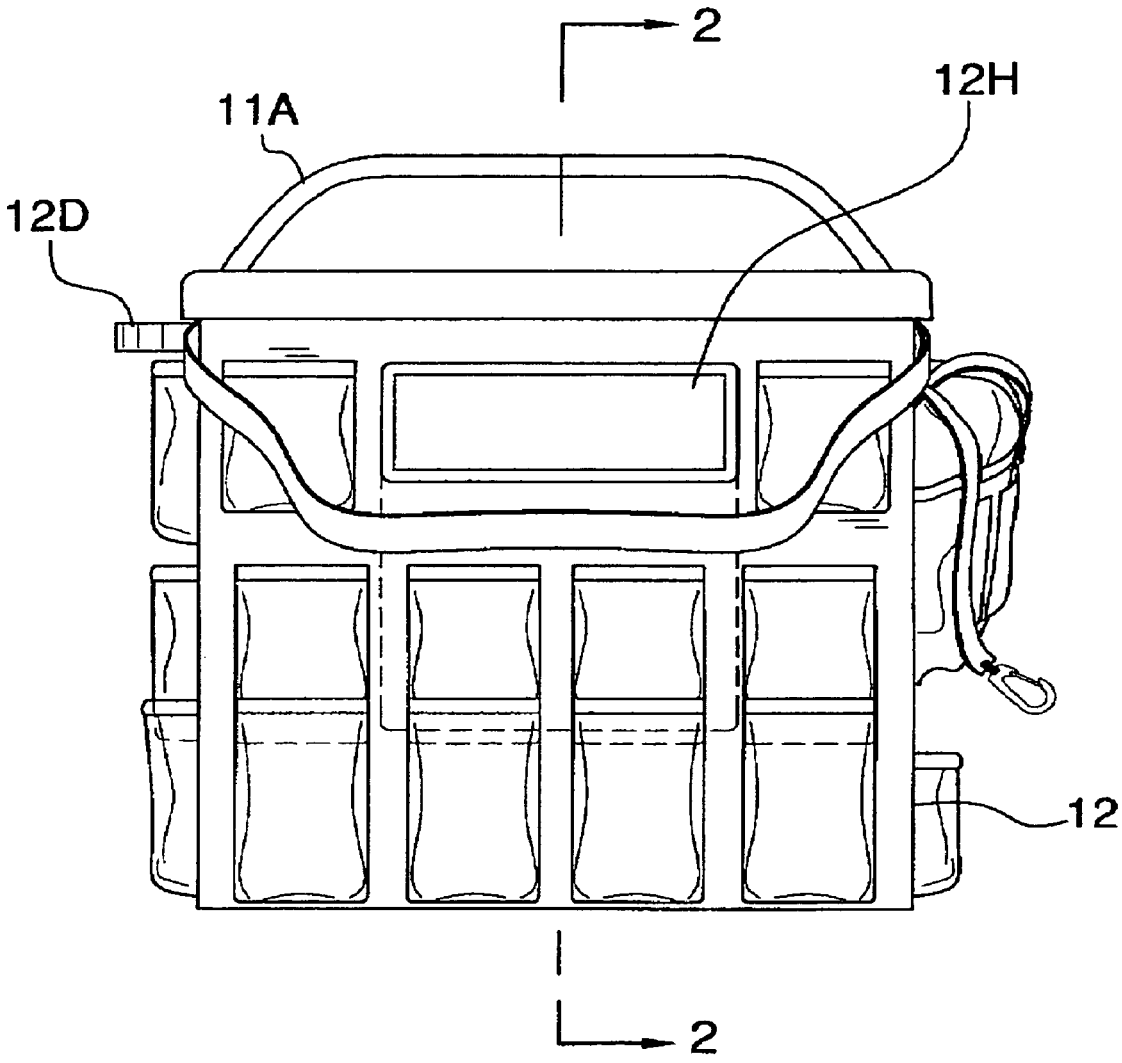
FIG. 1 illustrates a front view of the tool and supply bag.
Figure 2:
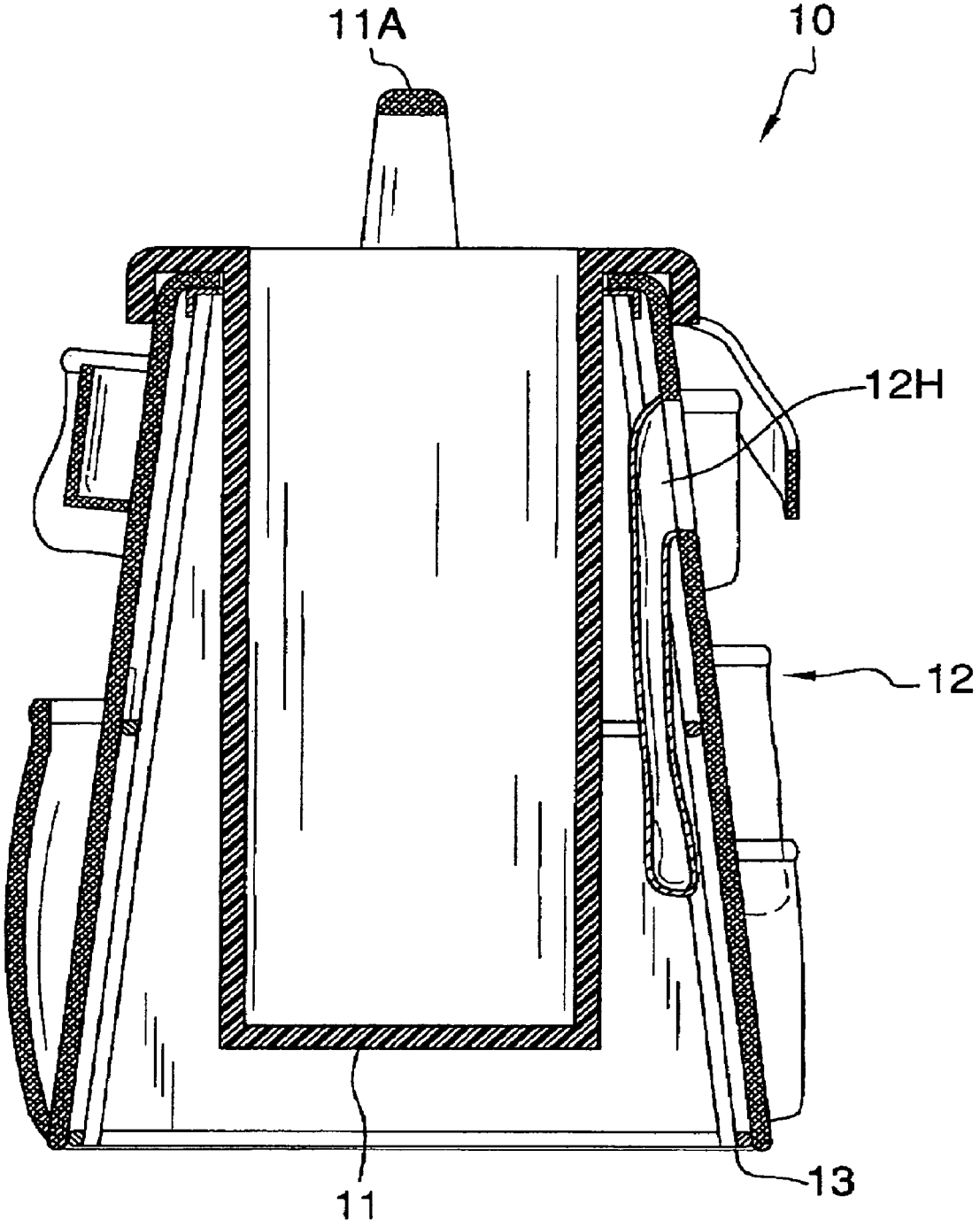
FIG. 2 illustrates a cross-sectional view of the tool and supply bag, the removable box, and the frame along line 2-2 in FIG. 1.
Figure 3:
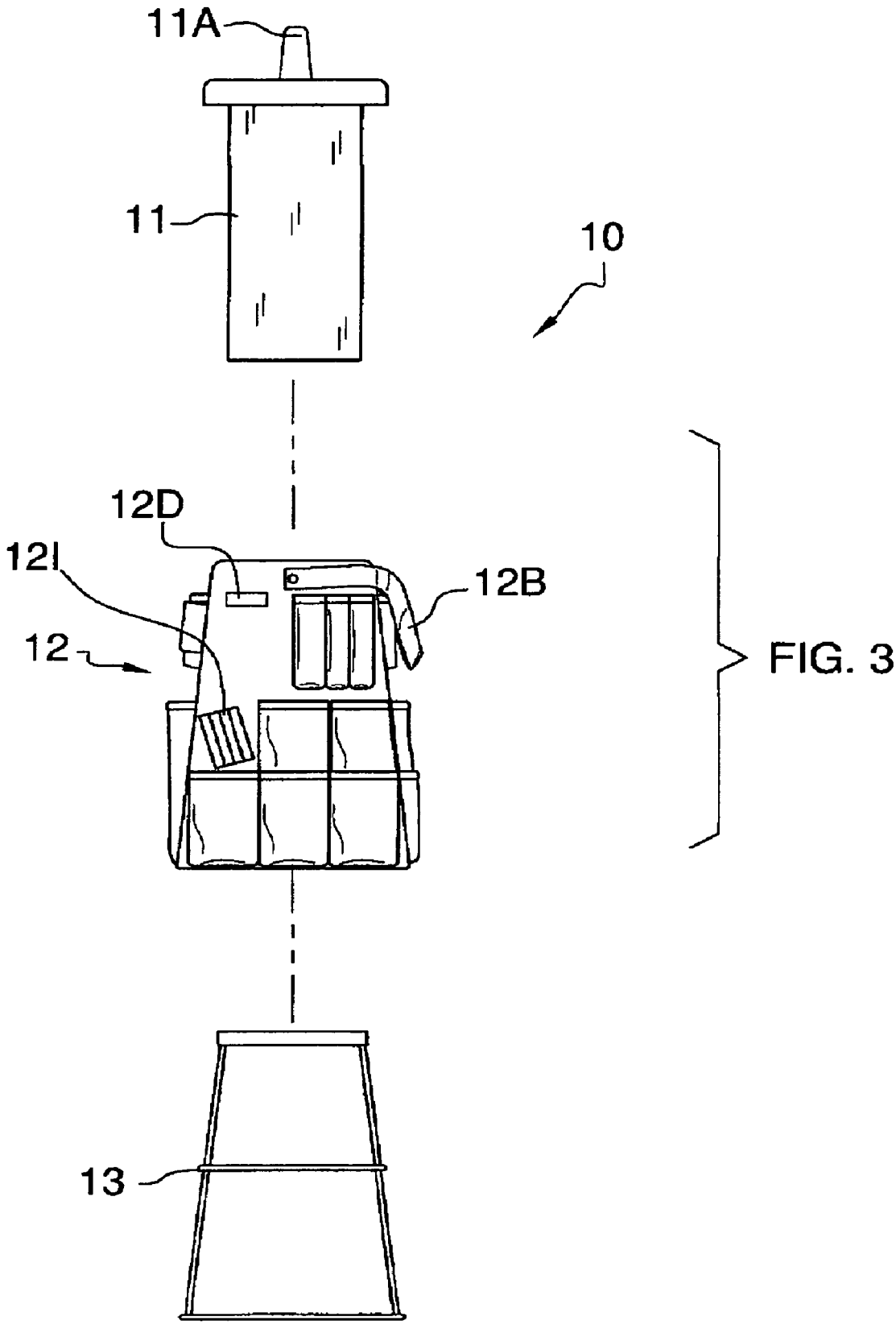
FIG. 3 illustrates an exploded view of the tool and supply bag, the removable box, and the frame.
Figure 4:
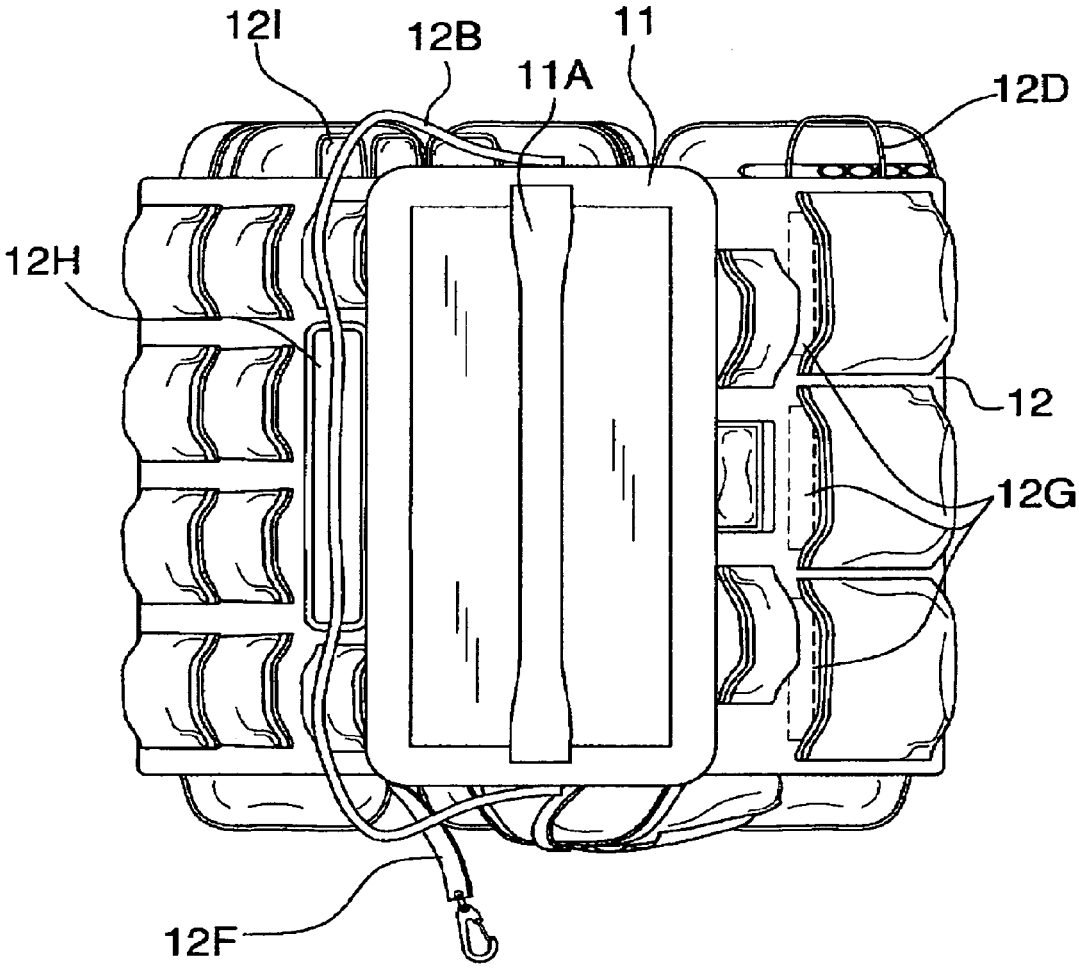
FIG. 4 illustrates a top view of the tool and supply bag, removable box.
Figure 5:
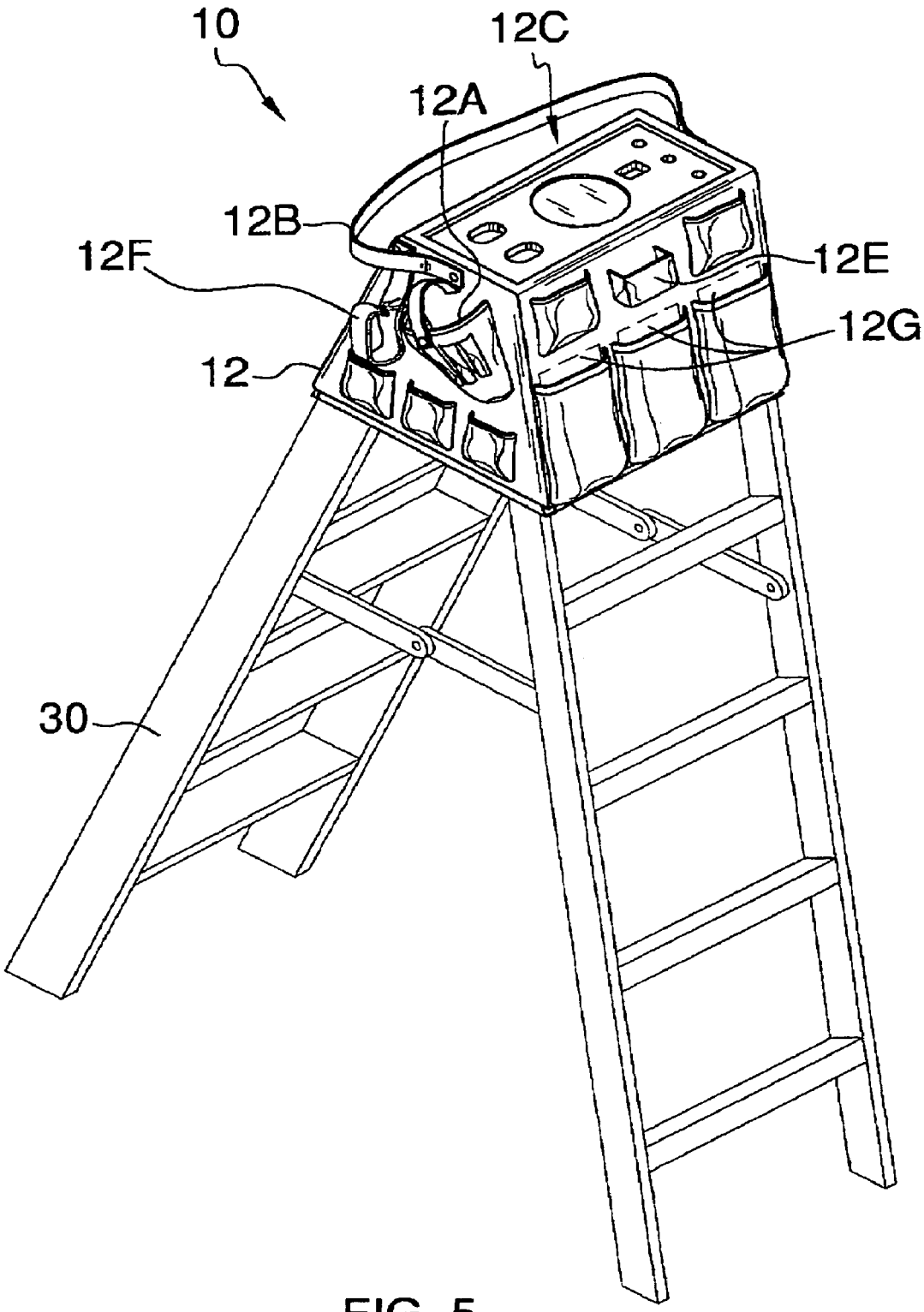
FIG. 5 illustrates an isometric view of the invention installed on a stepladder with the removable box removed.

The tool and supply bag 12 includes a strap 12F, which is useful in holding at least one roll of tape thereon. Some of the pockets of the tool and supply bag 12 include magnets 12G, which are useful in clinging metal or ferrous objects thereon. The tool and supply bag 12 includes a hideaway pocket 12H, which is depicted in FIG. 2, and is of greater volume than other pockets. Some of the pockets of the tool and supply bag 12, are narrow in width, and are pencil pockets 121, which are best suited for storing pencils, drill bits, or like-shaped objects.

When the tool and supply bag 12 is placed upon a stepladder 30, the top opening enables access with the top of said stepladder 30. That being said, placement of the tool and supply bag 12 upon the stepladder 30 requires removal of the removable box 11 prior thereto. The tool and supply bag 12 features a plurality of pockets and pouches for storing miscellaneous items irregardless of whether the tool and supply bag 12 is placed upon the stepladder 30, stands by itself, or is placed upon a non-self standing ladder 30 (see FIG. 6).

The removable box 11 has a handle 11A, and can fit within the opening 12C located at a top of the tool and supply bag 12. The frame 13 supports the removable box 11 when placed in the top opening 12C of the tool and supply bag 12. The removable box 11 is inserted into and removed from the frame 13 via the handle 11A. When the removable box 11 is removed from the tool and supply bag 12, the removable box 11 can be used by itself and carried around via the handle 11A.

The removable box 11 may be substituted for a cooler of similar dimensions. However, the removable box 11 may be an actual cooler.

The removable box 11 is made of a material comprising a metal, wood, plastic, or carbon fiber composite. It shall be noted that the removable box 11 may be made of an insulating material to double as a portable cooler.

The frame 13 is designed to rest atop the stepladder 30, and is made of a wire-frame construction, angle-iron construction, or both a wire-frame and angle iron construction. The frame 13 will lower itself down atop the stepladder 30, and cover the last 12 inches or so of the stepladder 30. The frame 13 must be made of a strong material, and wherein said material comprises a metal, durable plastic, or carbon fiber composite.

In addition to resting the frame 13 upon the stepladder 30, the frame 13 also supports the tool and supply bag 12 generally, and may enable usage of the invention 10 without a ladder. In other words, in the absence of the stepladder 30, the invention 10 can double as a step stool.

To use the invention 10, the removable box 11 must be removed prior to placement of the frame 13 and tool and supply bag 12 atop the stepladder 30. It is advisable to set up the stepladder 30 prior to placement of the invention 10 thereon.

The tool and supply bag 12 is generally permanently affixed about the exterior of the frame 13 via a fastening means. The fastening means comprises adhesive, tie strips, zip ties, rivets, or stitching the frame into the tool and supply bag 12. However, the tool and supply bag 12 may be geometrically shaped that the tool and supply bag 12 rests upon the frame 13, and thus requires no fastening means.

The tool and supply bag 12 is made of a material comprising a plastic or a flexible fabric further comprising a polyester, nylon, or cotton. Also, it shall be noted that the tool and supply bag may be treated with a waterproofing agent.

It shall be noted that other versions of the invention 10 may be adapted for use with other ladders that do not articulate out, or are not self-standing. In such a case, the frame would be adapted to fit over the top of the ladder.

With respect to the above description, it is to be realized that the optimum dimensional relationship for the various components of the invention 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A tool and supply bag for use with a stepladder further comprising:

a tool and supply bag that has a plurality of pockets and pouches adorning the exterior;

a frame that fits atop a stepladder, wherein said tool and supply bag is draped over said frame, and wherein said tool and supply bag has a top opening;

a removable box that fits within the top opening of said tool and supply bag and is further supported by the frame, and wherein said removable box is removed prior to placement of the frame atop of a stepladder.

2. The tool and supply bag as described in claim 1 wherein the tool and supply bag has a shoulder strap.

3. The tool and supply bag as described in claim 1 wherein the removable box has a handle.

4. The tool and supply bag as described in claim 1 wherein the tool and supply bag has a holster for stowing a cordless drill or like handled tool, a hammer loop for holding a hammer or like handled tool, and a center pocket that is used to store a tape measure.

5. The tool and supply bag as described in claim 4 wherein the holster includes a strap for securing tools therein.

6. The tool and supply bag as described in claim 1 wherein the tool and supply bag rests atop said frame or is permanently attached to the frame via a fastening means comprising an adhesive, zip ties, tie strips, rivets, or stitching the fabric of the tool and supply bag around said frame.

7. The tool and supply bag as described in claim 1 wherein said tool and supply bag, the frame, and the removable box can stand alone as a step stool.

8. The tool and supply bag as described in claim 1 wherein the tool and supply bag is made of a material comprising a plastic or flexible fabric further comprising a nylon, polyester, or cotton.

9. The tool and supply bag as described in claim 8 wherein the tool and supply bag is treated with a waterproofing agent.

10. The tool and supply bag as described in claim 1 wherein the frame is made of a material comprising a metal, durable plastic, or carbon fiber composite.

11. The tool and supply bag as described in claim 1 wherein the removable box is made of a material comprising a metal, wood, plastic, or carbon fiber composite.

12. The tool and supply bag as described in claim 1 wherein the frame is designed to sit upon a top rung of a ladder that is not self-standing.

13. A tool and supply bag for use with a stepladder further comprising:

a tool and supply bag that has a plurality or pockets and pouches adorning the exterior, and a shoulder strap; wherein the tool and supply bag has a holster for stowing a cordless drill or like handled tool and further includes a strap for securing tools therein, a hammer loop for holding a hammer or like handled tool, and a center pocket that is used to store a tape measure;

at least one of the pockets include magnets, which attract ferrous objects thereon;

a frame that fits atop a stepladder, wherein said tool and supply bag is draped over said frame, and wherein said tool and supply bag has a top opening;

a removable box that fits within the top opening of said tool and supply bag and is further supported by the frame, wherein said removable box has a handle, and wherein said removable box is removed prior to placement of the frame atop of a stepladder.

14. The tool and supply bag as described in claim 13 wherein the shoulder strap is removable.

15. The tool and supply bag as described in claim 13 wherein the tool and supply bag rests atop said frame or is permanently attached to said frame via a fastening means comprising an adhesive, zip ties, tie strips, rivets, or stitching the fabric of the tool and supply bag around said frame.

16. The tool and supply bag as described in claim 13 wherein the tool and supply bag is made of a material comprising a plastic or flexible fabric further comprising a nylon, polyester, or cotton.

17. The tool and supply bag as described in claim 16 wherein the tool and supply bag is treated with a waterproofing agent.

18. The tool and supply bag as described in claim 13 wherein the frame is made of a material comprising a metal, durable plastic, or carbon fiber composite.

19. The tool and supply bag as described in claim 13 wherein the removable box is made of a material comprising a metal, wood, plastic, or carbon fiber composite.

20. The tool and supply bag as described in claim 13 wherein the frame is designed to sit upon a top rung of a ladder that is not self-standing.

21. The tool and supply bag as described in claim 13 wherein said tool and supply bag, the frame, and the removable box can stand alone as a step stool.

* * * * *